United States Patent [19]

Soter, III

[11] 4,349,142

[45] Sep. 14, 1982

[54] ELECTRIC RUG BINDING SYSTEM

[76] Inventor: Richard A. Soter, III, 3421 Glen Ave., Baltimore, Md. 21215

[21] Appl. No.: 205,309

[22] Filed: Nov. 10, 1980

[51] Int. Cl.[3] ..... B25C 5/02; B25C 5/15

[52] U.S. Cl. ..... 227/13; 112/153; 112/169; 227/20; 227/131

[58] Field of Search ..... 227/12, 13, 16, 20, 227/131; 112/150, 153, 169; 271/251

[56] References Cited

U.S. PATENT DOCUMENTS

| | | | |
|---|---|---|---|
| 651,253 | 6/1900 | Knapp | 227/12 |
| 1,628,588 | 5/1927 | Friedman . | |
| 1,798,664 | 3/1931 | Friedman | 227/12 |
| 2,231,509 | 10/1943 | Scheckwirtz . | |
| 2,666,916 | 1/1954 | Spiegel et al. | 227/12 |
| 3,310,215 | 3/1967 | Bostick . | |
| 3,889,614 | 6/1975 | Nicolay et al. | 112/153 |
| 3,903,820 | 9/1975 | Kleinschmidt et al. | 112/153 |
| 3,934,329 | 1/1976 | Satkin | 29/453 |

*Primary Examiner*—Howard N. Goldberg
*Assistant Examiner*—Fred A. Silverberg
*Attorney, Agent, or Firm*—John F. MCClellan, Sr.

[57] ABSTRACT

A high speed, portable, rug binding machine in the form of an electric-powered hand-tool carrying and dispensing a roll of binding tape has floor-engaging canted wheels for directing the frame of the machine into a rug as it is rolled along a rug edge to which a binding is stapled by the machine as the operator pulls a trigger causing a solenoid to drive the stapler by way of a power linkage which automatically adjusts for rug and for binding thickness; the machine has adjustment for varying rug-to-binding holding force, prior to stapling, and rug introduction angle; simplicity of mechanism provides compactness and light weight suitable for one-hand manipulation by the operator under all conditions.

12 Claims, 4 Drawing Figures

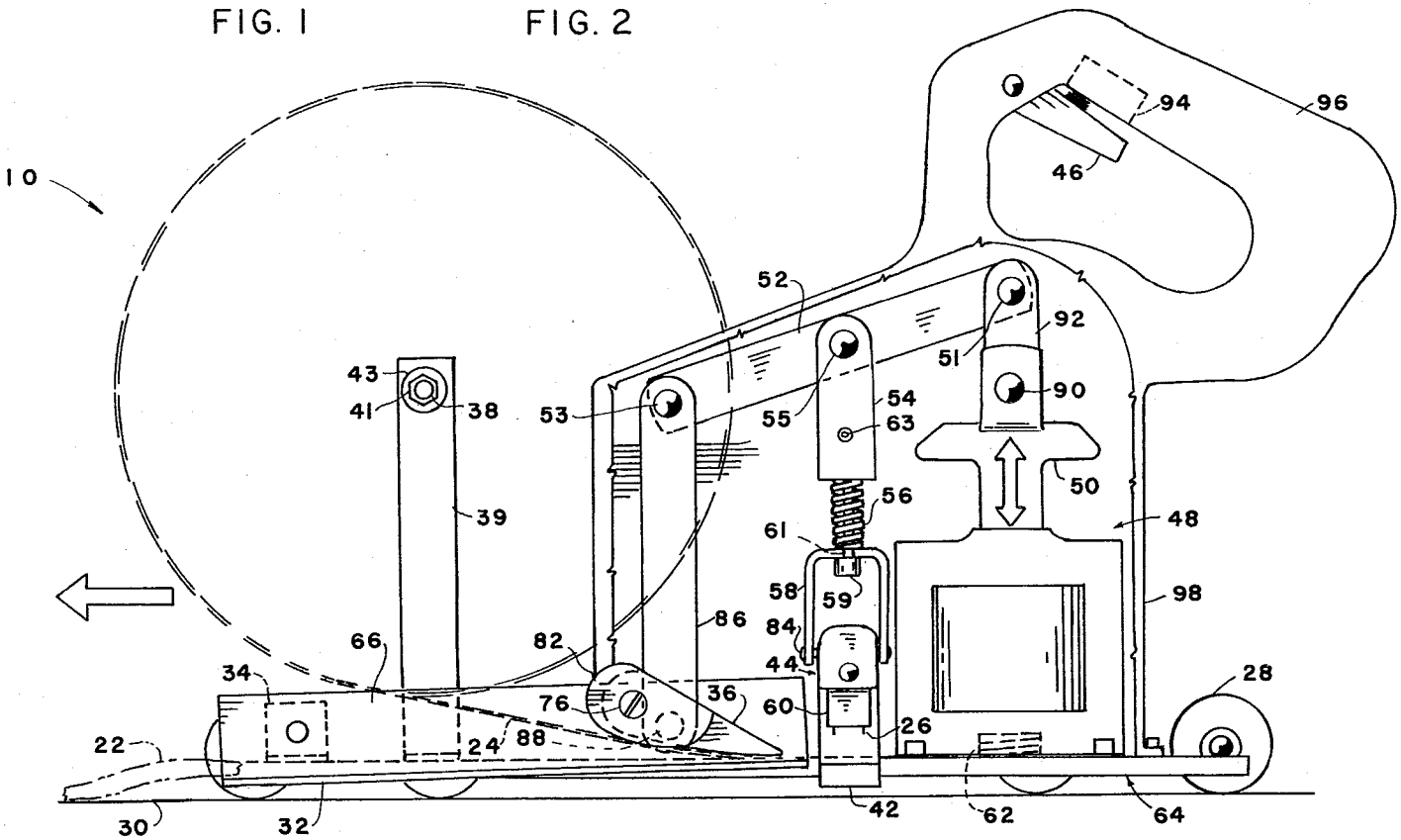
FIG. 1
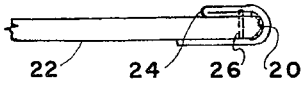
FIG. 2
FIG. 3

ELECTRIC RUG BINDING SYSTEM

FIELD OF THE INVENTION

This invention relates generally to power tools and specifically to a portable hand tool for affixing a tape binding along the margin of an edge of a rug.

BACKGROUND OF THE INVENTION

In the prior art various disclosures of portable hand tools have been made in which the tool affixes work or webs or elongate members relative to another object, including the following U.S. Pat. Nos.:

1,628,588 issued to S. Friedman on May 10, 1927, discloses a solenoid driven nailer with material handling feature;

2,331,509 issued to L. Scheckwitz, Oct. 12, 1943, discloses a stapler carrying a roll of material (thread 50) which is applied beneath the staples;

3,310,215 issued to L. D. Bostick on Mar. 21, 1967 discloses a stapler with reel provisions for carrying a wire into position to be affixed overhead;

3,934,329 issued to J. Satkin on Jan. 27, 1976 discloses a device for affixing fasteners to cloth.

However, the process of stapling bindings to rugs has been one of laborious manipulation of a conventional heavy duty stapler, manually positioning the device along a rug, manually laying tape and adjusting edge distance of tape and stapler, and manually pressing the stapler, then manually repeating this cycle hundreds of times for each rug.

OBJECTS OF THE INVENTION

Principal objects of the invention are to provide a system for rug binding which economically removes need for a table, speeds up the process and makes it at the same time less laborious and more nearly automatic, so that an unskilled person can bind a rug as uniformly and securely as, and several times faster than a trained worker who employs a conventional hand operated stapler for the purpose.

Further objects are to provide a system as described which is compact and lightweight so that it can be moved into place and directed along a rug using only one hand, which is nearly or entirely self-guiding, which is electrically powered, and requires only a moderate amount of power, which automatically accommodates for rug thickness and tape thickness in the power stroke, and which adjustably stretches the tape along the rug edge, insuring wrinkle-free affixation of tape to rug.

Still further objects are to provide a system as described which provides an adjustable rug-pickup, adjustable self-guiding bias and good surface traction for same, which is stable, safe, damage resistant, durable, which requires far less investment than fixed installations, which is convenient to load, is easy to learn to use, and which employs any suitable conventional, commercially available stapler and solenoid as the critical elements, for already-proven reliability.

BRIEF SUMMARY OF THE INVENTION

In brief summary given as cursive description only and not as limitation, the invention includes an assembly of longitudinal rug pickup coacting with a tape layer with tape stretcher and transversely deployed self-adjusting power stapler, the assembly carried on a carriage with wheel-bias for automatic positioning against the edge of a rug to be bound.

BRIEF DESCRIPTION OF THE FIGURES

The above and other objects and advantages of this invention will become more readily apparent from the following description, including the drawings, in which:

FIG. 1 is an end view of an edge portion of a rug showing a first rug binding in which a tape is laid on and affixed to the margin of a rug; this is as far as the present invention normally operates;

FIG. 2 is a similar view and shows a further step in rug binding, which may be completed by other means, such as cementing;

FIG. 3 is a side elevational view with a portion of the housing broken away from exposition and the tape shown in broken lines.

DETAILED DESCRIPTION OF THE FIGURES

Figure 4:
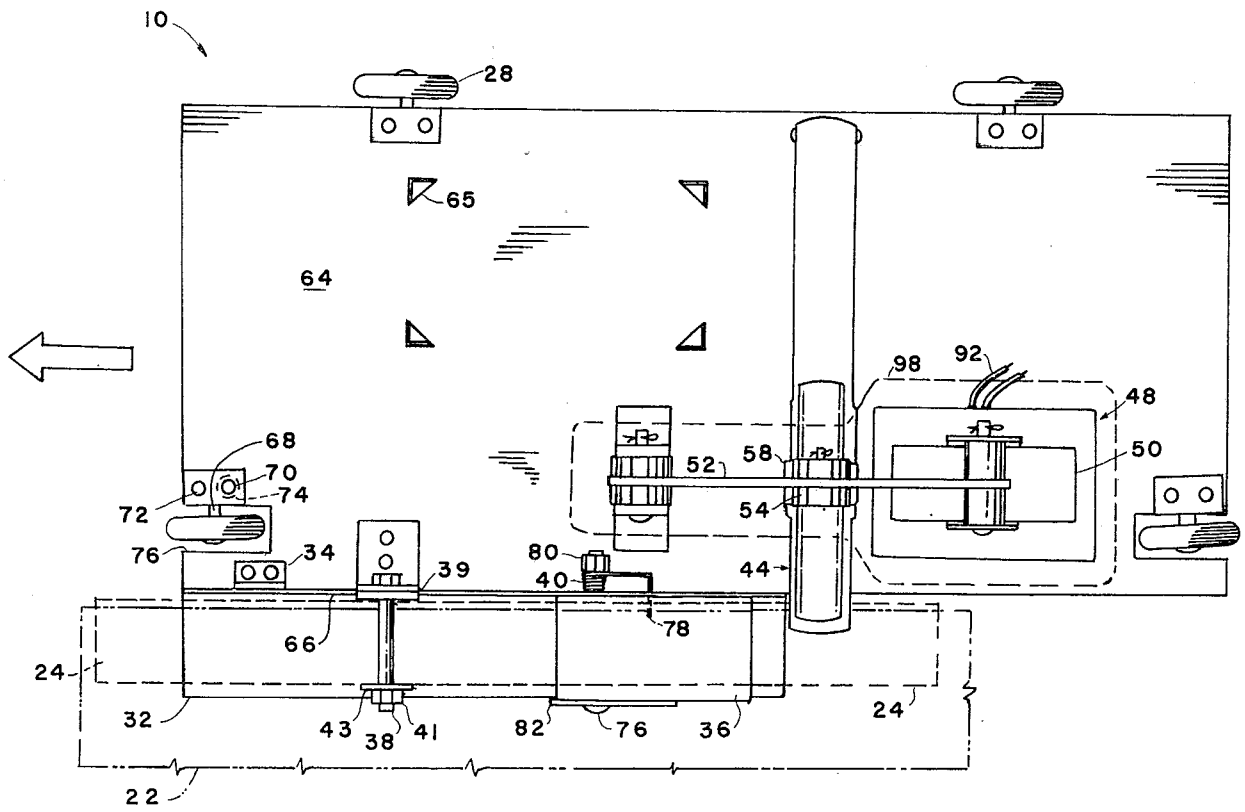
FIG. 4 is a top plan view with the tape shown in dashed lines and a portion of a rug being bound indicated in phantom lines extending beyond the tape.

FIG. 1 shows in end view the general, conventional operation in binding of an edge 20 of a rug 22 using a tape or web or strip of binding 24 which this invention accomplishes.

A staple 26 is driven through the tape laid on the upper margin of the rug and clinched beneath. This is repeated at intervals along the margin.

FIG. 2 shows the next operation, in which, following insertion and clinching of the staple 26, the tape 24 is folded or doubled-back around the edge 20 and under the rug 22, where the free edge of the tape is then secured, as by cementing. This edge can be stapled also, if acceptable for the installation, by inverting the rug and repeating the operation to be described in reference to the next Figures.

FIGS. 3 and 4 show the invention respectively in left-side elevational and top plan views and will be described together.

OPERATION

In operation, the system 10 is rolled on wheels 28 from right to left in the Figures (broad arrows). The margin of a rug 22 (fragmentarily shown in phantom lines) is picked up from the floor 30 or other surface on which it rests, by scoop plate 32. This is outboard the frame and comprises a straight length of angle adjustably bolted in place (as at angle bracket 34) so that the fore-and-aft angle can be set.

The scoop plate rises towards the rear of the unit and the rug margin then passes up on it and beneath a stretcher tab 36. The stretcher tab functions to press down onto the top of the rug margin and stretch along it a binding tape 24 received from reel 38 mounted forward of the stretch tab on rigid upright 39 and passing rearwardly beneath the stretcher tab on top of the rug margin.

Spring bias 40 (FIG. 4) adjustably forces trailing edge of the stretcher tab 36 down against the tape and rug margin, and friction on the coil of tape 24 is adjustable through presence of nut 41 on washer 43.

The tape and rug margin pass rearwardly from the stretcher tab at a level placing them on the lower jaw 42 of stapler 44. The stapler staples the tape and rug margin together at intervals determined by manual operation of trigger 46 (FIG. 3) which passes electric power to solenoid 48. The solenoid armature 50 at pivot 51 pulls down (arrow) the rearward end of lever arm 52 which pivots at 53 about the fixed forward end. This, through pivot 55, drives down link 54 which through compression spring 56 and yoke 58 depresses upper jaw 60 of the stapler, forcing a staple 26 through the tape and rug margin and clinching the staple by curling it against a conventional recess (not shown) in the lower jaw.

The compression spring is held between the bottom of link 54 and yoke 58 by a screw 59 threaded into the link and passing through the yoke at hole 61; a set screw 63 maintains adjustment of the selected position of screw 59. When the trigger is released a conventional spring bias restores it to the power-off position and a compression spring 62 under the solenoid armature plunger raises it again to the upper limit, preparing the unit for a succeeding cycle of staple driving after the device is advanced manually to the next position along the edge of the rug.

It will be appreciated from this description that the solenoid offset-linkage to the stapler reduces height relative to what the height would be if a superimposed solenoid were used, making the unit less top-heavy and more stable, and that the substantially two-to-one leverage advantage of the solenoid reduces instantaneous power requirements.

FURTHER STRUCTURAL DETAILS

The frame 64 of the invention comprises a simple rectangular plate of aluminum; it may be $\frac{1}{4}$ inch (6 mm) thick by $6\frac{1}{2}$ inches (15 cm) wide and 14 inches (35 cm) long, parallel with the floor surface and spaced at least $\frac{1}{8}$ inch (3 mm) from it. It may have corner clips 65 on it for holding a box of staples. Any other conventional holding means can be used for this.

The wheels 28 preferably are four, two at the forward end and two at the rearward end, all about two inches (5.0 cm) in diameter and having soft, circumferentially ribbed rubber tires for traction. At least one wheel and preferably the two wheels on the left side (as viewed looking forward) may be advantageously canted or oriented in plan view toward the rub to impose a left-turning moment or lateral bias on the unit, automatically self-guiding it against the rug edge at all times; the upright leg 66 of the angle of the scoop plate 32 holding the unit against the rug edge. Angle of the wheels is made adjustable by providing, as mounts for the axle 68, blocks 70 held to the base or frame by screw 72 in oversize holes 74. The left hand or steering or biasing wheels may be mounted in respective recesses 76 helping to sheld them against being knocked out of alignment.

The stretcher tab 36 is mounted to upright leg 66 on a pivotal screw 76 running through the rounded forward portion of the airfoil-shaped stretcher tab, and having (FIG. 4) one end of coil spring 40 passing through a transverse hole (not shown) in the screw and the other end 78 in a socket in the stretcher tab to bias it down; the shank may be square.

A nut 80 tightens the position of the pivotal screw for conventional adjustment of the spring force.

The trailing edge of the stretcher tab is tapered down from the leading edge and the bottom surface is preferably cylindrically convex near the trailing edge. The stretcher tab outboard edge preferably has a flange plate 82 on it extending forwardly and downwardly to contain the tape against lateral forces, for uniform installation. As noted, the inboard edge of the tape and the rug edge guide on the upright leg of the scoop plate.

The solenoid may be of any conventional design and the stapler any commercially available heavy duty unit of conventional design, preferably of the type loading from the rear for convenience, and pivoted at 84 to the yoke. It may be fixed in place with the working end recessed in the base plate (as shown in FIG. 3) to reduce height needed in raising the rug margin.

The lower end of upright, forward pivot arm 86 preferably pivots to the frame as at 88 to permit the lever system to center itself; for the same reason a second pivot 90 may be provided for the link 92 to the solenoid plunger.

The reel mounts on an upright 39 rigidly fixed to the baseplate and has a conventional removable nut-on-axle tape coil attachment permitting ready replenishment of the tape.

Assembly of all parts may be by means of screws, and clips where needed, or by any other conventional means. Wires 92 (FIG. 4) represent conventional wiring from a convenience outlet through a switch 94 (FIG. 3) actuated by the trigger at the one-hand piston grip handle 96, and then leading to the solenoid. The housing 98 is preferably integral with the handle and covers the electrical parts and most of the working parts, for safety. The frame is preferably aluminum.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A portable system for rug binding by fastening a tape at spaced intervals along a top margin of an edge of a rug disposed on a horizontal surface, comprising: a frame, means for manually directing the frame along a said rug edge including means for laterally biasing the system against the rug edge and means for lifting a portion of the rug marginally along the rug edge; means for dispensing the tape along the top margin of the rug edge, means for pressing and stretching the tape downward along said top margin prior to said fastening, a trigger, and means for power driving and affixing a staple through the tape and the top margin upon each actuation of the trigger.

2. A portable system as recited in claim 1, and means for automatic adjustment of the means for power driving to tapes and rugs of differing thicknesses.

3. A portable system as recited in claim 2, wherein the means for power driving includes a solenoid, stapler fixed transversely in the frame and means connecting the solenoid with the stapler, and wherein the means for automatic adjustment includes a spring and a linkage positioned for driving the stapler through bias supplied by said spring.

4. A portable system as recited in claim 3, wherein the means for pressing and stretching the tape comprises a stretcher tab with leading edge and trailing edge, with a rounded portion in position for receiving a said tape and rug margin therebelow and above said means for lifting, means pivotally mounting the stretcher tab leading edge, and means for forcing the stretcher tab trailing edge downwardly.

5. A portable system as recited in claim 4, the means for lifting comprising a scoop plate mounted outboard the frame in a fore-and-aft direction.

6. A portable system as recited in claim 5, said stapler having an upper jaw and a lower jaw, and the scoop plate being forward of the stapler and including a horizontal portion and an upright portion; the scoop angle being adjustable relative to the frame for lifting a rug margin to a level passing the rug margin over the stapler lower jaw.

7. A portable system as recited in claim 6, the means for dispensing tape including a reel mounted on the frame for rotationally holding a coil of tape, and means for adjusting the rotational friction of said holding, for adjusting said stretching of the tape.

8. A portable system as recited in claim 2, the means for laterally biasing the system including a plurality of wheels on the frame, and at least one of said wheels oriented in a direction for steering the frame towards a rug edge as part of said directing.

9. A portable system as recited in claim 8, said wheels having respective axles, and a respective block adjustably secured to the frame and holding a respective axle.

10. A portable system as recited in claim 9, said frame having a plurality of recesses therein a said wheel in each recess.

11. A portable system as recited in claim 8, the means for manually directing including a one-hand piston grip handle, and said trigger being in said handle with connection for electrically actuating the power driving means.

12. A portable system as recited in claim 11, and means for self-centering said power driving.

* * * * *